United States Patent [19]

Dominguez

[11] Patent Number: 4,702,044

[45] Date of Patent: Oct. 27, 1987

[54] MODIFIED ARCH SUPPORT

[76] Inventor: Peter R. Dominguez, 36 Trail Street, Wagga Wagga, New South Wales 2650, Australia

[21] Appl. No.: 656,591

[22] Filed: Oct. 1, 1984

[30] Foreign Application Priority Data

Oct. 5, 1983 [AU] Australia ..... PG1706

[51] Int. Cl.[4] ..... E04B 1/32

[52] U.S. Cl. ..... 52/86; 135/102; 16/334

[58] Field of Search ..... 52/80, 85, 86, 127.2; 135/102, 103, 104, 106; 248/351; 182/128; 249/10, 11, 12, 13, 160, 163, 170; 16/334, 339

[56] References Cited

U.S. PATENT DOCUMENTS

| | | | |
|---|---|---|---|
| 1,963,269 | 3/1933 | Butler | 135/106 X |
| 2,575,572 | 11/1951 | Wickstrum | 135/102 X |
| 3,849,953 | 11/1974 | Cohen | 52/86 |
| 4,011,628 | 3/1977 | Bengtsson | 16/339 X |
| 4,540,306 | 9/1985 | Wang | 16/334 X |

FOREIGN PATENT DOCUMENTS

| | | | |
|---|---|---|---|
| 806170 | 12/1958 | United Kingdom | 135/103 |
| 976404 | 11/1964 | United Kingdom | 16/334 |
| 2122676 | 1/1984 | United Kingdom | 249/13 |

*Primary Examiner*—William F. Pate, III
*Assistant Examiner*—Creighton Smith
*Attorney, Agent, or Firm*—Hayes, Davis & Soloway

[57] ABSTRACT

An adjustable arch support used for the laying of brickwork, lamination of timber beams, or other similar uses which incorporates a flexible band supported by a number of telescopic struts from a central hub. The shape of the arch is determined by adjustment of the struts, bending the band to the desired configuration.

The band incorporates at least one lockable hinge allowing the band to be set either to an even curve or to a discontinuous curve having a peak at the hinge for the formation of Gothic arches, etc.

4 Claims, 4 Drawing Figures

MODIFIED ARCH SUPPORT

BACKGROUND OF THE INVENTION

This invention relates to a modified building arch support and has been devised particularly though not solely as a modification of the arch support described in my Australian Pat. No. 525,237.

In arch supports of the type described in my Australian Pat. No. 525,237 which are used to define the shape of an archway (for use when laying up bricks or laminating a timber beam for example), it has hitherto been necessary to provide a variety of different arch supports for use in forming arches of different configurations. Some arches have a smooth even curve across the entire arch, whereas other arches, such as a gothic arch, may have a peak or other places where the line of the arch makes an abrupt change in angle. This has been dealt with in the past by providing a number of different types of arch supports, one for each different type of arch required. This is, of course, expensive and it is desirable to provide a single arch support which may be used for arches of different configurations.

SUMMARY OF THE INVENTION

It is therefore an object of the present invention to provide a modified arch support which will obviate or minimize the foregoing disadvantages, or go at least part of the way toward meeting the foregoing desiderata, in a simple yet effective manner, or which will at least provide the public with a useful choice.

Accordingly the invention consists in a device for supporting an arch during construction operations, comprising a hub member, a plurality of struts pivotally connected to the hub member and extending away from the hub member in one plane and in respective directions independently capable of adjustment relative to one another and relative to the hub member, an elongate load support band connected to the outer ends of the struts and adapted to support a load between the struts, said band being sufficiently flexible to permit alteration of the shape of the band upon adjustment of the struts, characterised by the provision of at least one lockable hinge in the load support band enabling the band to bend sharply through a predetermined angle in the said plane at the location of the hinge and to retain said predetermined angle by the locking of the hinge.

Preferably said one or each lockable hinge is located in said band at the point of connection of the outer end of a strut to the band.

Preferably the lockable hinge comprises first and second hinge leaf members interconnected by a hinge pin allowing relative rotational movement along the axis of the pin between said hinge leaf members, an abutment extending from said first leaf member, and clamping means extending from said second leaf member adapted to engage and clamp said abutment to prevent relative rotation of said leaf members about said hinge pin.

Preferably said clamping means comprises two arms extending from said second leaf member on either side of said abutment and tension means adapted to draw said arms together to clamp said abutment therebetween.

Preferably said tension means comprise a bolt or stud extending between the free ends of said arms.

Preferably said abutment includes pivotal attachment means for the outer end of one of the struts.

DESCRIPTION OF THE DRAWINGS

Notwithstanding any other forms that may fall within its scope, one preferred form of the invention will now be described by way of example only with reference to the accompanying drawings in which.

DESCRIPTION OF THE PREFERRED EMBODIMENT

In the preferred form of the invention, an arch support of the type described in my Australian patent specification No. 525,237 is constructed having a central hub or pin 1 (FIG. 3) from which radiate a plurality of struts 2 all substantially located in one plane. Each strut is pivotally connected to the hub 1 and is preferably telescopic or otherwise adjustable in length. The outer ends of the struts are connected to an elongate load supporting band 3 which is typically a strip of sheet steel.

Figure 4:
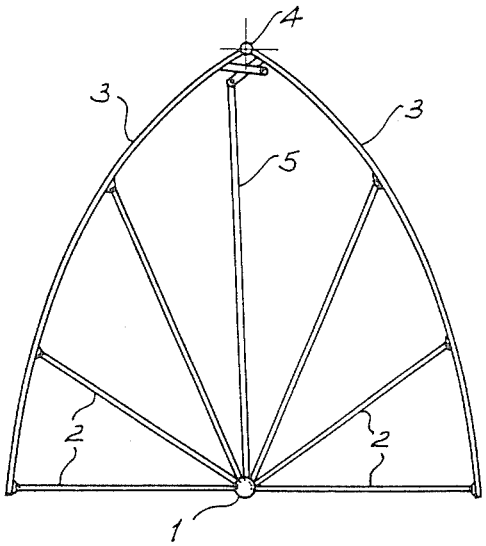
FIG. 4 is a similar view to FIG. 3 showing the arch support in an alternative configuration.

In the form of arch support according to the invention, the elongate band 3 is provided with a hinge 4 at at least one point in the elongate band so that the hinge may be pivoted through a desired angle to achieve arch configurations in which the elongate band is discontinuous in its curve in at least one location. A typical application is in the construction of a gothic arch as shown in FIG. 4 where the hinge 4 is located at the peak of the arch as can clearly be seen in FIG. 4. It is preferable although not essential that the hinge 4 be located at the free end of one of the struts 2 and preferably of the central strut 5.

Figure 3:
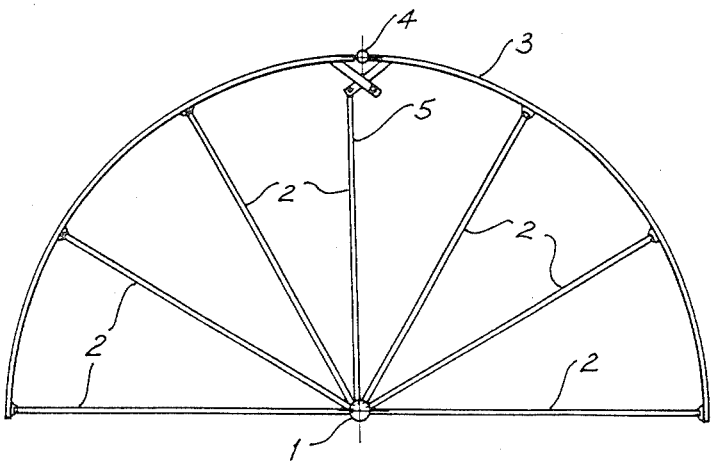
FIG. 3 is a side view of an arch support according to the invention.

So that the same arch support may be used to provide a fair and even curve as shown in FIG. 3 or a discontinuous curve as shown in FIG. 4, it is necessary that the hinge 4 be able to be locked in a desired configuration.

A typical example of such a lockable hinge will now be described with reference to FIGS. 1 and 2 of the accompanying drawings. The hinge comprises a first leaf member 11 and a second leaf member 12 which are typically formed by the ends of two segments of the elongate band 3. The two leaf members are interconnected by a hinge pin 13 at right angles to the plane of the struts allowing relative rotational movement along the axis of the pin between the hinge leaf members 11 and 12 as is well known in conventional hinges.

Figure 1:
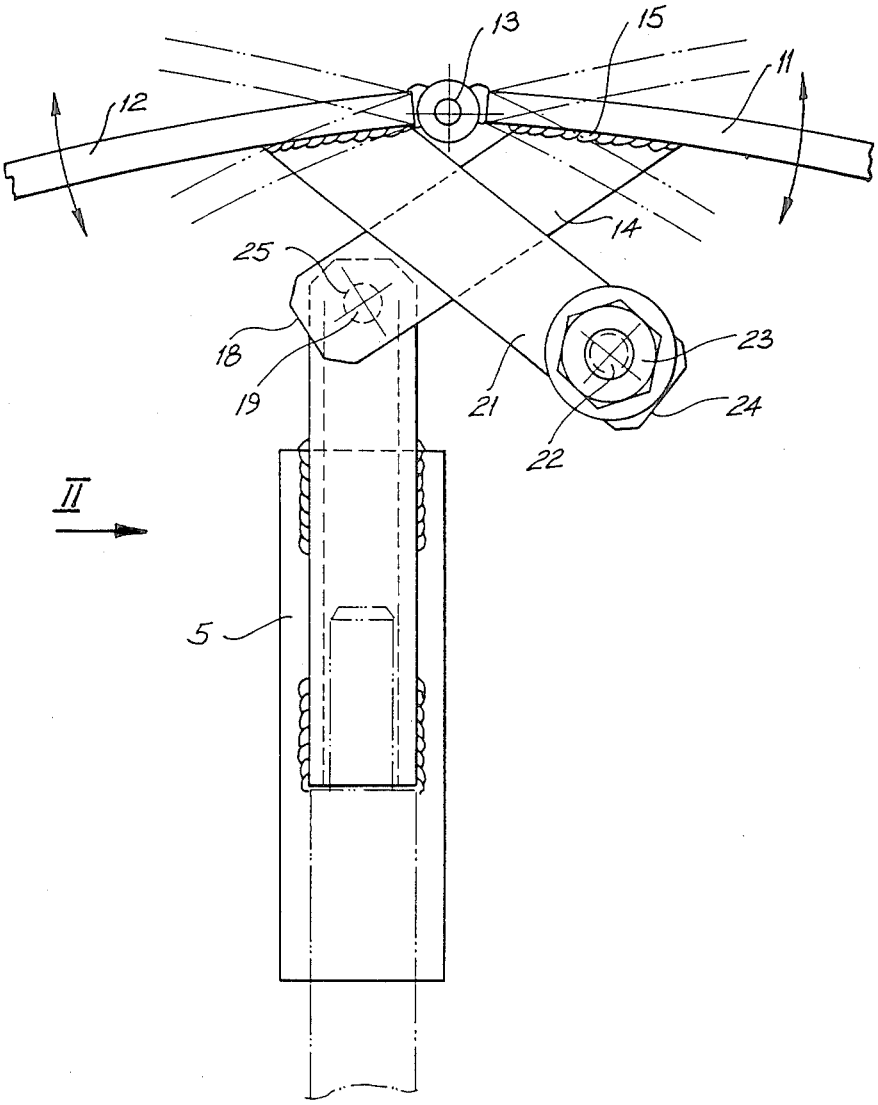
FIG. 1 is a side view of a lockable hinge incorporated in an arch support according to the invention.
Figure 2:
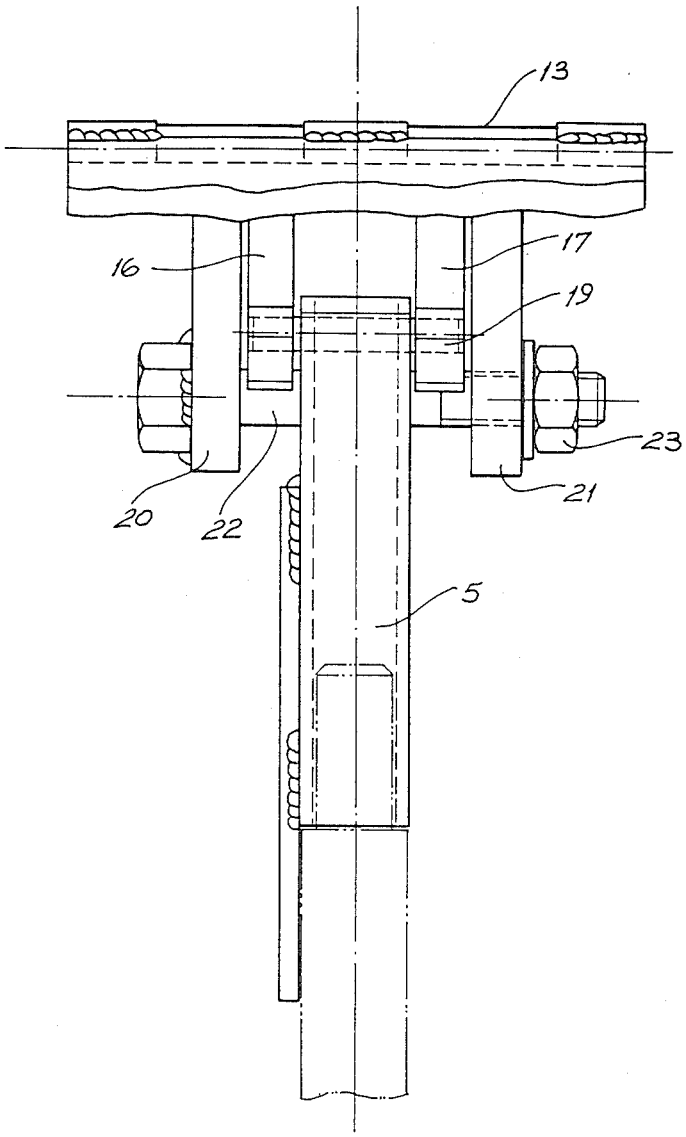
FIG. 2 is an end view on the arrow II of the construction shown in FIG. 1.

The first leaf member is provided with an abutment 14 extending from the leaf member as shown in FIG. 1. The abutment may be in the form of a section of steel bar welded to the first leaf member at 15 but in the preferred form of the invention the abutment is formed from two arms 16 and 17 solidly connected adjacent their free ends 18 by a pivot pin 19.

The second leaf member 12 is provided with clamping means in the form of two arms 20 and 21, typically welded to the second leaf member and extending outwardly therefrom on either side of the abutment 14. The clamping arms 20 and 21 are provided with tension means in the form of a threaded bolt 22 and corresponding nut 23 interconnecting their free ends 24 so that the nut and bolt may be tightened causing the arms 20 and 21 to be drawn together and clamp the abutment 14 therebetween. In use of the hinge the nut and bolt 22 and 23 are loosened and the first and second hinge leaf members rotated relative to one another about the hinge pin 13 until the desired angle is reached. The nut and bolt are then tightened, clamping the abutment between the arms 20 and 21 and preventing any further undesired rotation about the hinge pin 13. In this manner the desired angle for the hinge 4 may be preset in the elongate load supporting band 3.

It is preferred that the hinge 4 be located at the end of one of the struts 2 and to this end the typical strut 5 is pivotally engaged with the hinge by way of a hole 25 in one end of the strut engaging the pin 19 in the abutment 14. In this manner the end of the strut 5 is pivotally connected to the lockable hinge.

Although the invention has been described by way of one particular example with a single lockable hinge 4 at the centre or apex of the arch support, it will be appreciated that similar lockable hinges may be provided wherever else desired in the elongate band 3.

In this manner a modified arch support is provided which enables a single arch support to be adapted by presetting the lockable hinge or hinges to give any desired configuration of arch.

What I claim is:

1. A device for supporting an arch during construction operations, comprising a hub member, a plurality of struts pivotally connected to the hub member and extending away from the hub member in one plane and in respective directions independently capable of adjustment relative to one another and relative to the hub member, an elongate load support band connected to the outer ends of the struts and adapted to support a load between the struts, said band being sufficiently flexible to permit alteration of the shape of the band upon adjustment of the struts, characterized by the provision of at least one lockable hinge in the load support band enabling the band to bend sharply through a predetermined angle in the said plane at the location of the hinge and to retain said predetermined angle by the locking of the hinge, wherein the lockable hinge comprises first and second hinge leaf members interconnected by a hinge pin allowing relative rotational movement along the axis of the pin between said hinge leaf members, an abutment extending from said first leaf member, and clamping means extending from said second leaf member adapted to engage and clamp said abutment to prevent relative rotation of said leaf members about said hinge pin.

2. A device for supporting an arch during construction operations as claimed in claim 1, wherein said clamping means comprise two arms extending from said leaf member on either side of said abutment, and tension means adapted to draw said arms together to clamp said abutment therebetween.

3. A device for supporting an arch during construction operations as claimed in claim 2, wherein said tension means comprise a bolt or stud extending between the free ends of said arms.

4. A device for supporting an arch during construction operations as claimed in claim 1, wherein said abutment includes pivotal attachment means for the outer end of one of the struts.

* * * * *